US009622632B2

(12) United States Patent
Han et al.

(10) Patent No.: US 9,622,632 B2
(45) Date of Patent: Apr. 18, 2017

(54) CYCLONE DUST COLLECTOR AND VACUUM CLEANER HAVING THE SAME

(71) Applicant: SAMSUNG ELECTRONICS CO., LTD., Suwon-si, Gyeonggi-do (KR)

(72) Inventors: Jung Gyun Han, Gwangju (KR); Joung Soo Park, Jeonju (KR); Dong Won So, Ansan (KR); Jong Gook Lim, Gwangju (KR); Kyong Hui Jeon, Seosan (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 406 days.

(21) Appl. No.: 14/302,927

(22) Filed: Jun. 12, 2014

(65) Prior Publication Data

US 2014/0366311 A1 Dec. 18, 2014

(30) Foreign Application Priority Data

Jun. 12, 2013 (KR) ..... 10-2013-0067033

(51) Int. Cl.
*A47L 9/19* (2006.01)
*A47L 9/28* (2006.01)
*A47L 9/16* (2006.01)

(52) U.S. Cl.
CPC *A47L 9/19* (2013.01); *A47L 9/16* (2013.01); *A47L 9/2821* (2013.01)

(58) Field of Classification Search
CPC ..... A47L 9/1666; A47L 9/16; A47L 7/0028; A47L 9/19; A47L 7/0038; A47L 7/0042; A47L 9/2821
See application file for complete search history.

(56) References Cited

U.S. PATENT DOCUMENTS

| | | | | |
|---|---|---|---|---|
| 4,060,050 | A | 11/1977 | Simonsson | |
| 4,100,878 | A | 7/1978 | Leinfelt | |
| 4,399,585 | A * | 8/1983 | Kullik | A47L 9/2821 15/319 |
| 5,033,151 | A * | 7/1991 | Kraft | A47L 9/2821 15/319 |
| 6,467,123 | B1 * | 10/2002 | Di Nunzio | A47L 9/0072 15/339 |
| 2007/0295209 | A1 * | 12/2007 | Strauser | B01D 45/16 95/271 |
| 2014/0237767 | A1 * | 8/2014 | Conrad | A47L 9/2857 15/353 |

OTHER PUBLICATIONS

Extended European Search Report dated Jan. 29, 2015 in European Patent Application No. 14170310.8.
European Decision on Grant dated Mar. 17, 2016 in European Patent Application No. 14170310.8.

* cited by examiner

*Primary Examiner* — Robert Scruggs
(74) *Attorney, Agent, or Firm* — Staas & Halsey LLP

(57) ABSTRACT

A cyclone dust collector includes a cyclone chamber to centrifugally separate dust by creating rotating airflow, and a ring-shaped indicator provided to the cyclone chamber to rotate due to the rotating airflow in the cyclone chamber. The indicator visualizes the rotating airflow by rotating when the rotating airflow is created. The user may easily check condition of the rotation airflow and take proper action in the case that the cleaner malfunctions.

25 Claims, 16 Drawing Sheets

CYCLONE DUST COLLECTOR AND VACUUM CLEANER HAVING THE SAME

CROSS-REFERENCE TO RELATED APPLICATIONS

This application claims the benefit of Korean Patent Application No. 10-2013-0067033, filed on Jun. 12, 2013 in the Korean Intellectual Property Office, the disclosure of which is incorporated herein by reference.

BACKGROUND

1. Field

Embodiments of the present invention relate to a vacuum cleaner having a cyclone collector.

2. Description of the Related Art

A vacuum cleaner is a home appliance used to perform cleaning operation. The vacuum cleaner generally includes a fan motor to generate suction force, a suction part to suction air on a surface to be cleaned using suction force of the fan motor, and a dust collector to separate dust from the air suctioned through the suction part, collect the separated dust, and discharge purified air.

A cyclone dust collector, which is a dust collector that separates dust from the suctioned air using centrifugal force, is widely used since it is semi-permanently usable and more hygienic and convenient than other dust collectors that employ a dust bag.

The cyclone dust collector is applicable to any type of vacuum cleaner including a canister type vacuum cleaner, an upright type vacuum cleaner, or a hand type vacuum cleaner.

A rotating airflow generated in the cyclone dust collector is not visible to the naked eye. Accordingly, it is not easy for a user to determine whether or not the cyclone dust collector is operating normally. That is, in the case that the fan motor malfunctions or a flow passage is blocked, suction force and cleaning efficiency are degraded, but the user may fail to recognize the same.

SUMMARY

Therefore, it is an aspect of the present invention to provide a cyclone dust collector which indicates rotating airflow in a cyclone chamber at a glance.

Additional aspects of the invention will be set forth in part in the description which follows and, in part, will be obvious from the description, or may be learned by practice of the invention.

In accordance with one aspect of the present invention, a cyclone dust collector includes an inlet portion to suction air therethrough, a cyclone chamber to centrifugally separate dust by rotating the air suctioned through the inlet portion, a dust collecting chamber communicating with the cyclone chamber to collect the dust separated through the cyclone chamber, a cylindrical outlet provided in the cyclone chamber to allow the air having undergone removal of the dust to be discharged from the cyclone chamber therethrough, and an indicator mounted to the outlet so as to be rotated by rotating airflow in the cyclone chamber, the indicator including a ring-shaped body and a plurality of blades protruding radially outward from the body.

Herein, the indicator may be rotatably mounted to a circumferential surface of the outlet to surround the outlet.

The outlet may include a grille adapted to filter out dust particles having a size greater than or equal to a certain size.

An inner diameter of the body of the indicator may be greater than an outer diameter of the outlet.

The outlet may include a separation preventing part protruding radially outward from a lower end of the outlet to prevent the indicator from being separated from the outlet.

The blades may be spaced a predetermined distance from each other in a circumferential direction.

Each of the blades may be formed in a shape of a linear rod or a non-linear rod.

The blades may be inclined with respect to a horizontal plane.

The indicator may further include a brush provided to an inside of the body in a radial direction to clean the outlet when the indicator rotates.

The cyclone dust collector may further include a case forming an external appearance of the cyclone dust collector and provided therein with the cyclone chamber, wherein the case may be formed of a transparent material to allow the indicator to be seen through the case from outside of the case.

The indicator may have a color or be fluorescent.

In accordance with another aspect of the present invention, a cyclone dust collector includes a cyclone chamber to centrifugally separate dust by creating rotating airflow, a dust collecting chamber communicating with the cyclone chamber to collect the dust separated through the cyclone chamber, a cylindrical guide provided in the cyclone chamber to guide the rotating airflow in the cyclone chamber, and an indicator mounted to the guide so as to be rotated by the rotating airflow in the cyclone chamber, the indicator including a ring-shaped body and a plurality of blades protruding radially outward from the body.

Herein, the indicator may be rotatably mounted to a circumferential surface of the guide to surround the guide.

An inner diameter of the body of the indicator may be greater than an outer diameter of the guide.

In accordance with another aspect of the present invention, a cyclone dust collector includes a cyclone chamber to centrifugally separate dust by creating rotating airflow, a dust collecting chamber communicating with the cyclone chamber to collect the dust separated through the cyclone chamber, and a ring-shaped indicator provided in the cyclone chamber so as to be rotated by rotating airflow in the cyclone chamber.

Herein, the indicator may include a plurality of blades protruding radially outward from the indicator.

The cyclone dust collector may further include a cylindrical part inserted in a hollow of the indicator to rotatably support the indicator.

Herein, an inner diameter of the indicator is greater than an outer diameter of the cylindrical part.

In accordance with a further aspect of the present invention, a vacuum cleaner includes a fan motor to generate suction force, a suction head to suction air from a surface to be cleaned with suction force of the fan motor, and a cyclone dust collector connected to the suction head to suction air, centrifugally separate and collect dust, and discharge purified air, wherein the cyclone dust collector includes a cyclone chamber to centrifugally separate dust by creating rotating airflow, a dust collecting chamber communicating with the cyclone chamber to collect the dust separated through the cyclone chamber, and a ring-shaped indicator provided in the cyclone chamber so as to be rotated by the rotating airflow in the cyclone chamber.

In accordance with another aspect of the present invention, a vacuum cleaner includes a cyclone dust collector generating rotating airflow and comprising an indicator indicating a force of the rotating airflow in the cyclone dust collector.

The indicator may be a ring-shaped indicator rotated by the rotating airflow. Moreover, a reduction in the rotating airflow may be indicated by the indicator.

Further, the vacuum cleaner may include a main body, and a suction part to suction air from a surface to be cleaned with suction force produced in the main body. The cyclone dust collector may be connected to the suction part to suction air, centrifugally separate and collect dust, and discharge purified air.

The indicator may indicate at least one of a reduction in the suctioning of the air by the suction part and a reduction in the suction force produced in the main body.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
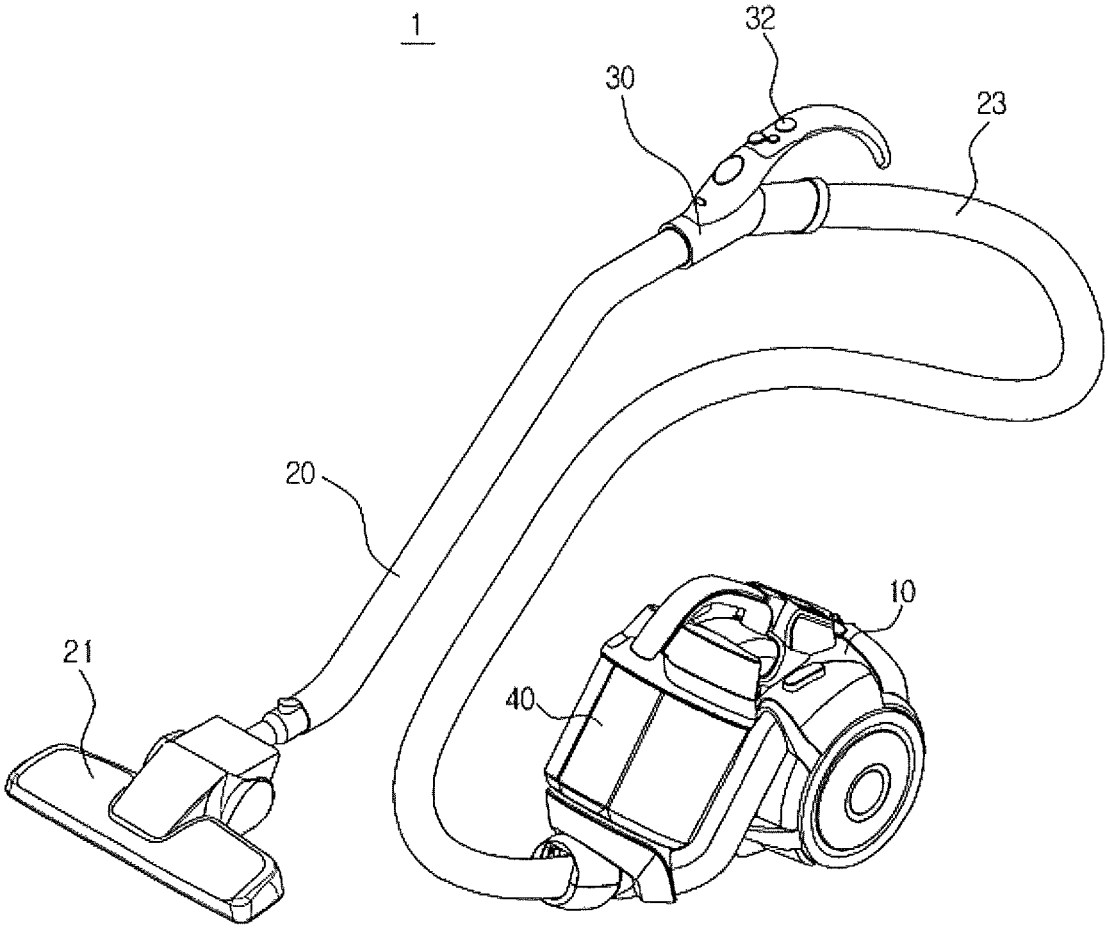
FIG. 1 is a view illustrating a vacuum cleaner according to an exemplary embodiment of the present invention.

Reference will now be made in detail to the embodiments of the present invention, examples of which are illustrated in the accompanying drawings, wherein like reference numerals refer to like elements throughout.

Figure 2:
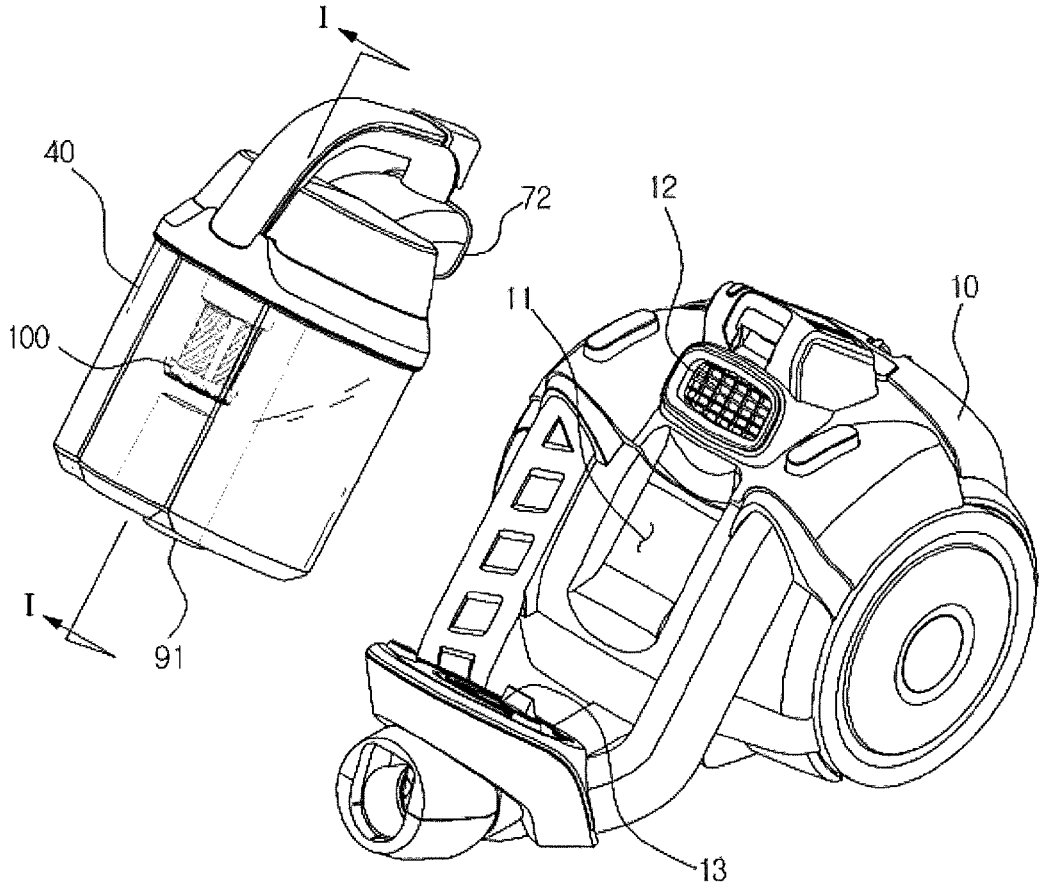
FIG. 2 is a view illustrating the vacuum cleaner of FIG. 1, in which the cyclone dust collector is separated from the main body.

FIG. 1 is a view illustrating a vacuum cleaner according to an exemplary embodiment of the present invention, FIG. 2 is a view illustrating the vacuum cleaner of FIG. 1, in which the cyclone dust collector is separated from the main body.

Referring to FIGS. 1 and 2, the vacuum cleaner 1 of this embodiment includes a main body 10, a cyclone dust collector 40 mounted to the main body 10, and a suction part 21 to closely contact a surface to be cleaned to suction air.

The main body 10 is provided with a fan motor (not shown) to generate suction force. Air on a surface to be cleaned and dust contained in the air may be suctioned through the suction part 21 by the suction force generated by the main body 10. The suction part 21 may be formed to be wide and flat to closely contact the surface to be cleaned.

An extension pipe 20 formed of resin or metal, a handle pipe 30 manipulated by a user, a flexible hose 23 formed of a flexible material to allow free movement of the handle pipe 30 may be provided between the main body 10 and the suction part 21. That is, the vacuum cleaner 1 of this embodiment corresponds to a canister type vacuum cleaner. A manipulation part 32 allowing manipulation of functions of the vacuum cleaner may be provided to the handle pipe 30.

The suction part 21, the extension pipe 20, the handle pipe 30, and the flexible hose 23 may be arranged to communicate with each other. Accordingly, the air suctioned through the suction part 21 may sequentially pass through these constituents and flow into the main body 10. The main body 10 is provided with a suction port 12 to guide the suctioned air to the cyclone dust collector 40 and a discharge port 13 allowing the air purified in the cyclone dust collector 40 to be discharged. The discharge port 13 may communicate with a fan motor chamber (not shown) in which a fan motor (not shown) is arranged.

The main body 10 may be provided with a mounting part 11 to which the cyclone dust collector 40 is mountable. The cyclone dust collector 40 may be detachably mounted to the mounting part 11. The cyclone dust collector 40 serves to separate dust from the air suctioned through the suction part 21, collect the separated dust, and discharge the purified air.

The cyclone dust collector 40 includes an inlet 91 through which air containing dust is introduced, and an outlet 72 through which purified air is discharged. When the cyclone dust collector 40 is mounted to the main body 10, the inlet 91 of the cyclone dust collector 40 may be allowed to communicate with the suction port 12 of the main body 10, and the outlet 72 of the cyclone dust collector 40 may be allowed to communicate with the discharge port 13 of the main body 10.

The cyclone dust collector 40 generates rotating airflow such that air and dust are separated from each other by centrifugal force. Accordingly, when the fan motor (not shown) is driven, rotating airflow is generated in the cyclone dust collector 40. Since the rotating airflow is simply flow of air, it is difficult to visually check the airflow.

Accordingly, it may be difficult for a user to recognize whether or not the rotating airflow is generated in the cyclone dust collector 40. As a result, it may not be easy to determine whether the vacuum cleaner 1 is normally operating, i.e., degradation of suction force of the fan motor (not shown) or clogging of a flow passage.

As shown in FIG. 2, the cyclone dust collector 40 is provided with an indicator 100 adapted to rotate due to the rotating airflow. This is intended to visualize rotating airflow in the cyclone dust collector 40. A user may recognize the rotating airflow through rotation of the indicator 100.

In an embodiment, the indicator 100 is included in the flow passage of the rotating airflow to indicate a force of the rotating airflow. Thus, a reduction of the force of the airflow in the cyclone dust collector will be apparent to the user by observation of the indicator 100. Accordingly, degradation of the suction force of the fan motor or clogging of the flow passage will be indicated by the indicator 100.

The user may recognize generation of rotating airflow in the cyclone dust collector 40 based on rotation of the indicator 100, and may roughly estimate malfunction of the vacuum cleaner 1, i.e., degradation of suction force or clogging of the flow passage based on the rate of rotation of the indicator 100. Thus, the user may properly take necessary actions such as, for example, repair or replacement of the fan motor (not shown) and cleaning or replacement of an internal filter.

Hereinafter, configuration and operation of the cyclone dust collector 40 with the indicator 100 will be described in detail with reference to the drawings.

Figure 3:
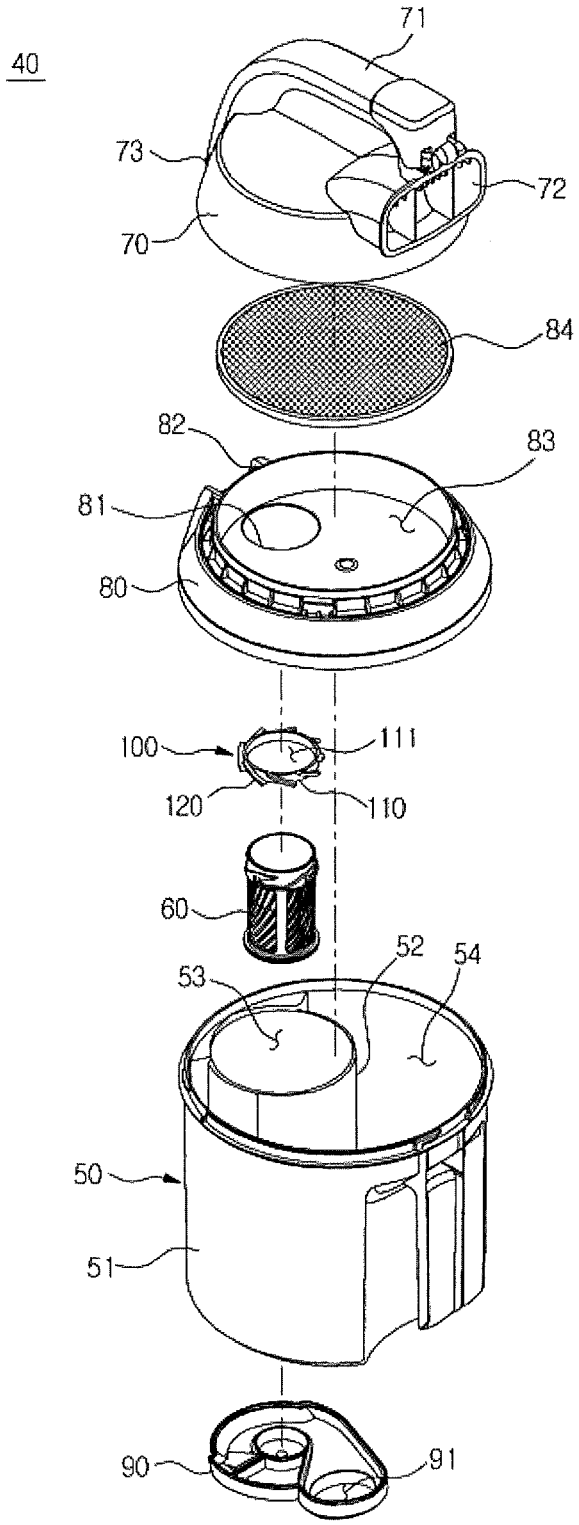
FIG. 3 is an exploded perspective view illustrating the cyclone dust collector of FIG. 1.
Figure 4:
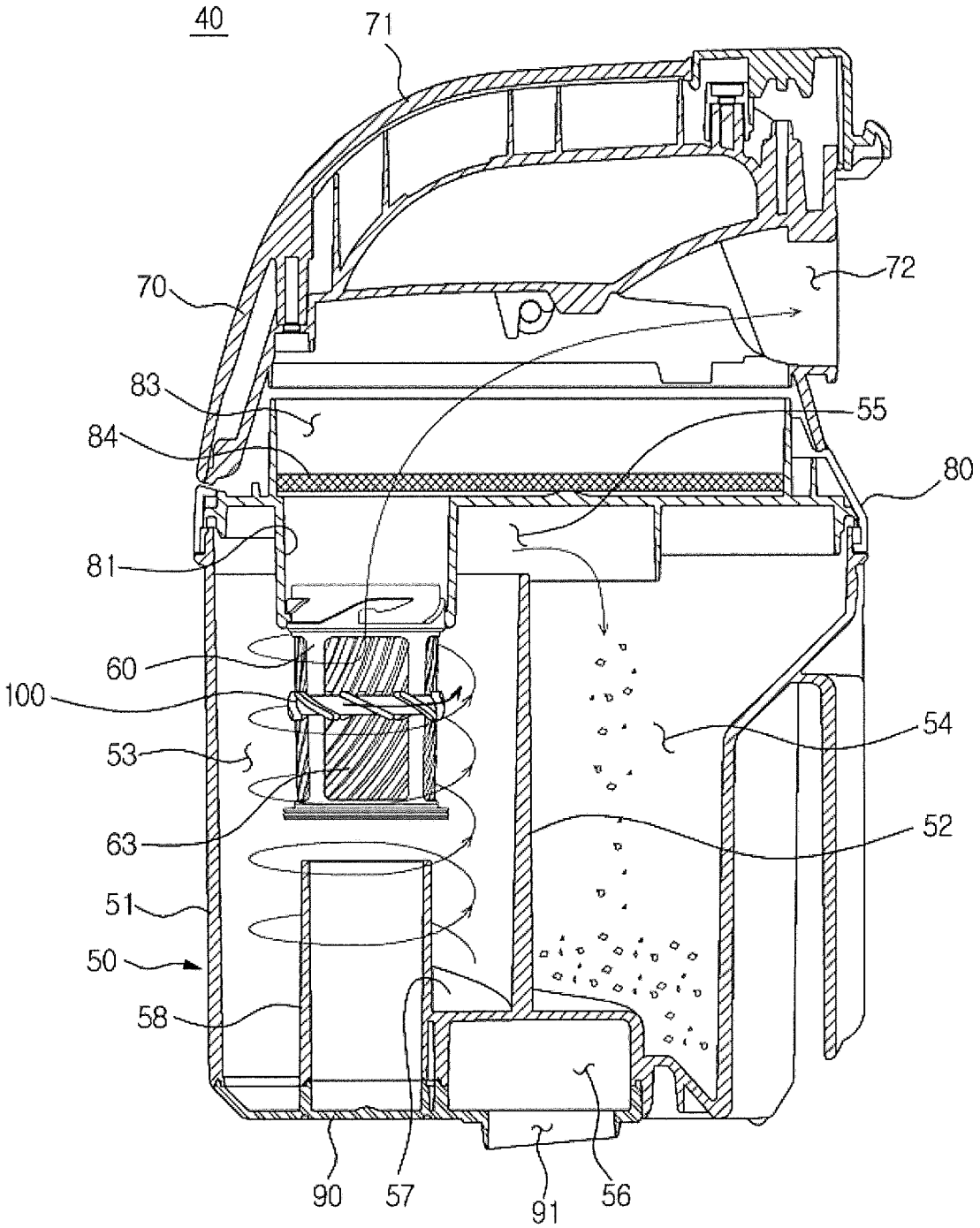
FIG. 4 is a cross-sectional view taken along line I-I of FIG. 1.
Figure 5:
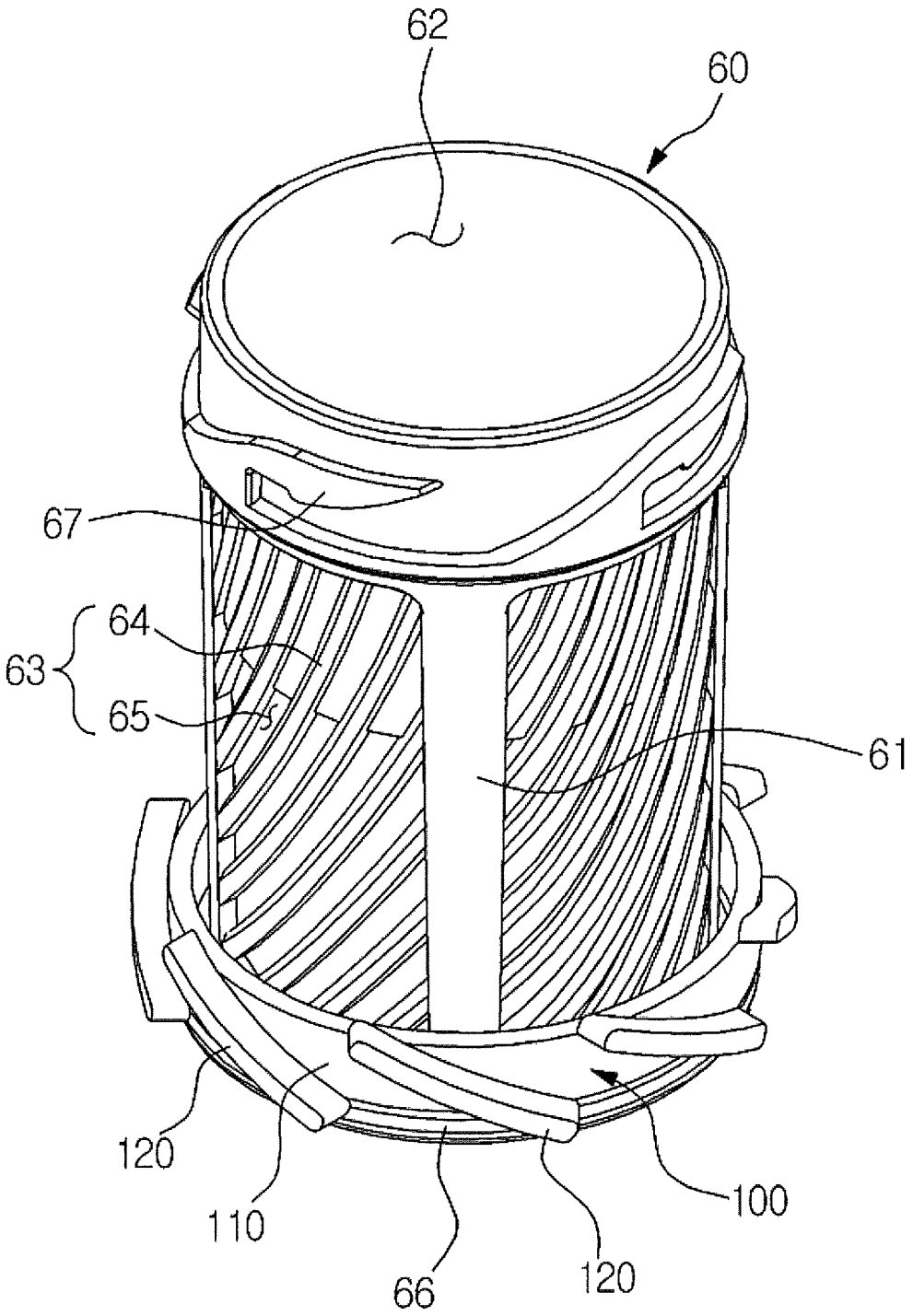
FIG. 5 is a perspective view illustrating the outlet and indicator of FIG. 1.
Figure 6:
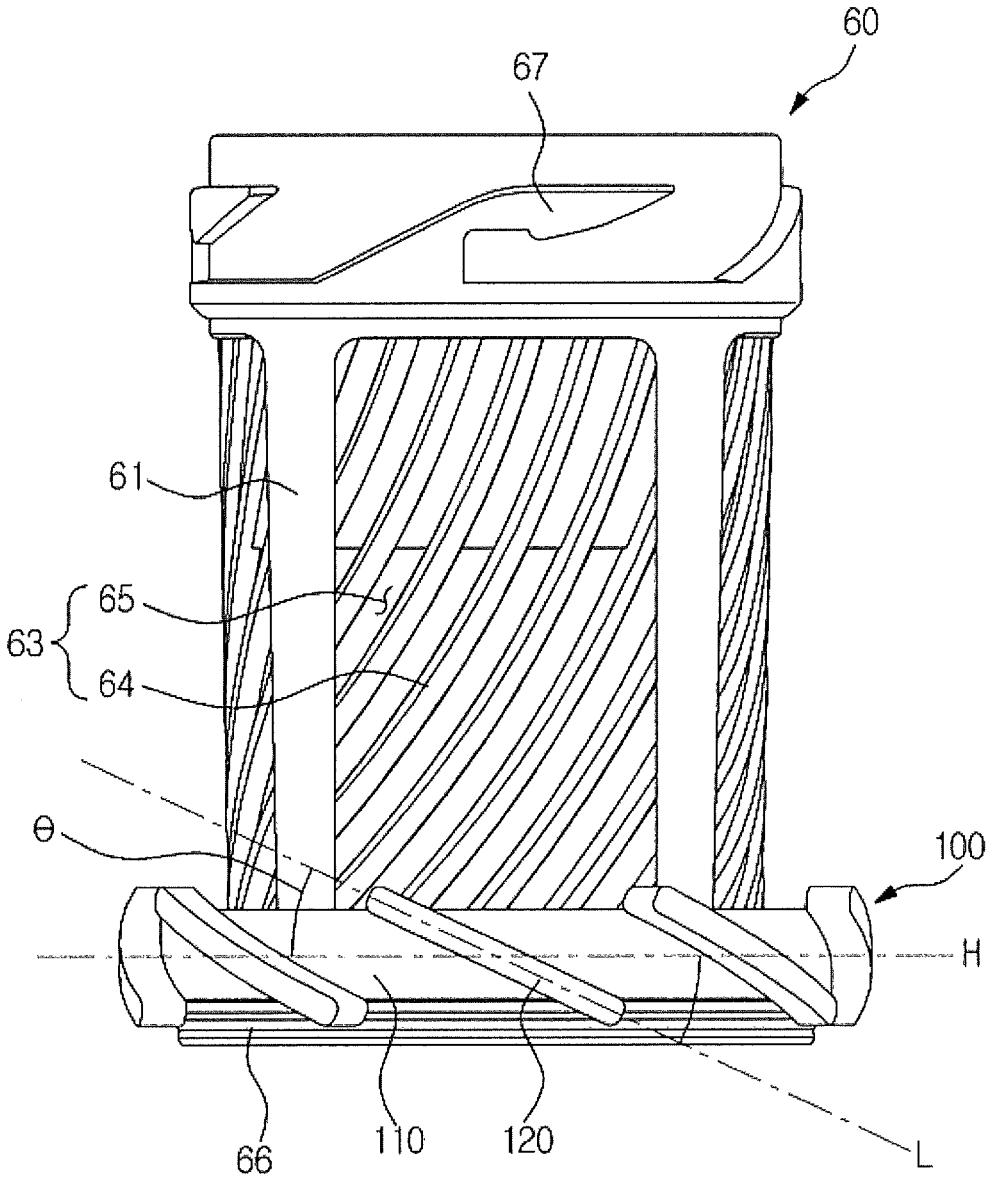
FIG. 6 is a side view illustrating the outlet and indicator of FIG. 1.
Figure 7:
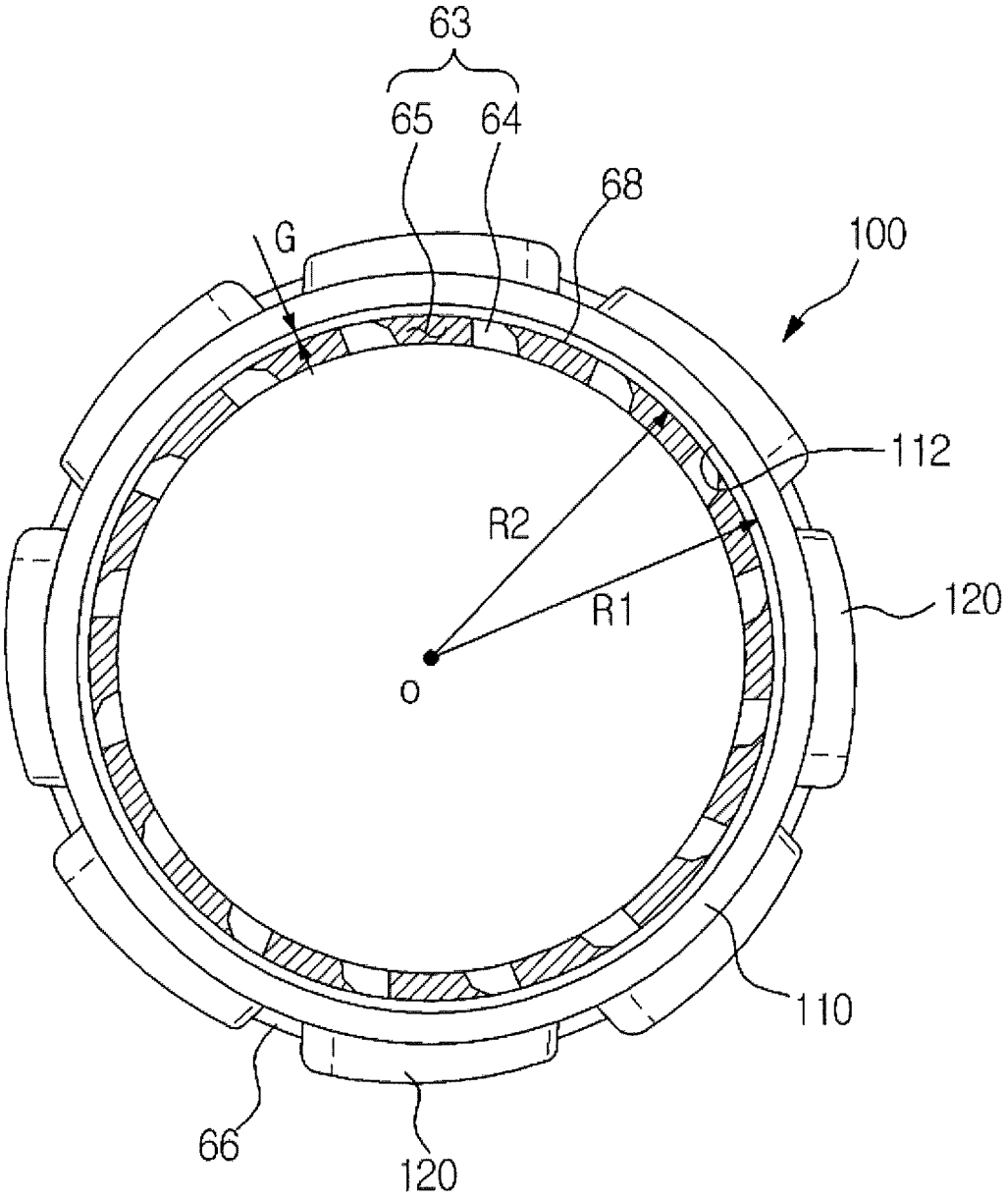
FIG. 7 is a plan view illustrating the outlet and indicator of FIG. 1.

FIG. 3 is an exploded perspective view illustrating the cyclone dust collector of FIG. 1. FIG. 4 is a cross-sectional view taken along line I-I of FIG. 1. FIG. 5 is a perspective view illustrating the outlet and indicator of FIG. 1. FIG. 6 is a side view illustrating the outlet and indicator of FIG. 1, and FIG. 7 is a plan view illustrating the outlet and indicator of FIG. 1.

In the cross-sectional view of FIG. 4, appearances of the outlet 60 and the indicator 100 viewed from the front are shown and cross sections thereof are not shown, for simplicity of illustration.

The cyclone dust collector 40 may include a case 50 approximately formed in the shape of a cylinder having open upper and lower surfaces, an upper cover 70 provided to the upper portion of the case 50, a middle cover 80 provided between the upper cover 70 and the case 50 to cover the upper surface of the case 50, and a lower cover 90 coupled to the lower portion of the case 50 to cover the open lower surface of the case 50.

The middle cover 80 may be detachably coupled to the upper surface of the case 50 to cover the upper surface of the case 50. The upper cover 70 may be arranged at the upper side of the middle cover 80 and rotatably hinged to the middle cover 80. To this end, a hinge shaft 73 is provided to one side of the upper cover 70, and a hinge shaft receiving part 82 to accommodate the hinge shaft 73 may be provided to one side of the middle cover 80.

The cyclone dust collector 40 may be integrally formed. In addition, the case 50 may have a cylindrical shape or may not have a cylindrical shape.

The case 50, the upper cover 70, the middle cover 80, and the lower cover 90 are components that respectively form a portion of the external appearance of the cyclone dust collector 40. The case 50, the upper cover 70, the middle cover 80, and the lower cover 90 may be formed of a transparent material to allow the internally arranged indicator 100 to be seen from the outside thereof.

Only a few of the components forming the external appearance of the cyclone dust collector 40 may be formed of a transparent material so long as the indicator 100 arranged in a cyclone chamber 53 is viewable from the outside of the cyclone dust collector 40.

Formed in the case 50 are the cyclone chamber 53, in which rotating airflow is created to separate dust through centrifugal force, and a dust collecting chamber 54 to collect the dust. To this end, the case 50 may include an outer wall 51 forming an external appearance of the case 50, and an inner wall 52 arranged inside the outer wall 51 to partition the cyclone chamber 53 and the dust collecting chamber 54 from each other.

An opening 55 (FIG. 4) is formed in the upper portion of one side of the inner wall 52 to allow the cyclone chamber 53 and the dust collecting chamber 54 to communicate with each other such that the dust separated from the air in the cyclone chamber 53 flows into the dust collecting chamber 54. Since the dust heavier than air is dispersed outwardly by centrifugal force, the opening 55 is formed at the outer circumference of the cyclone chamber 53.

The cyclone chamber 53 may be approximately formed in a cylindrical shape to create rotating airflow, and a guide 58 approximately formed in a cylindrical shape may be provided to the center of the cyclone chamber 53 to guide the rotating airflow. A spiral part 57 that is spirally inclined may be arranged around the guide 58. Thereby, air may turn around the guide 58 along the spiral part 57.

The cyclone dust collector 40 further includes an inlet portion 56 through which air is introduced into the cyclone chamber 53, and an outlet 60 through which the air is discharged from the cyclone chamber 53. The air introduced through the dust collector the inlet 91 of the lower cover 90 may enter the cyclone chamber 53 through the inlet portion 56.

Meanwhile, the outlet 60 may be provided to the center of the cyclone chamber 53 to discharge the air purified by removing dust from the cyclone chamber 53.

As best shown in FIG. 5, the outlet 60 may be approximately formed in the shape of a cylinder having an inner space.

The outlet 60 may include a grille 63 to secondarily filter out dust from the air from which dust is primarily removed by the centrifugal force. The grille 63 may be formed on the circumferential surface 61 of the outlet 60. Although not separately shown, the grille 63 may also be formed on the lower surface of the outlet 60.

The grille 63 may include a grille body 64 and an air through hole 65 formed in the grille body 64. The air through hole 65 may not allow dust particles larger than or equal to a certain size externally introduced through the outlet 60 to pass therethrough into an inner space 62. The dust particles having been blocked from passing through the air through hole 65 may be rotated again by the rotating airflow of the cyclone chamber 53 and then finally collected in the dust collecting chamber 54.

The air through hole 65 of this embodiment is formed in the shape of teeth of a comb, but embodiments of the present invention are not limited thereto. The air through hole 65 may be formed in various commonly known shapes.

A coupling part 67 coupled to a discharge pipe 81 of the middle cover 80 may be provided to an upper portion of the outlet 60. The outlet 60 may be detachably coupled to the discharge pipe 81 through the coupling part 67.

In addition, the outlet 60 may include a separation preventing part 66 to prevent separation of the indicator 100 mounted to the outlet 60. The separation preventing part 66 may protrude radially outward from the lower end of the outlet 60. In this embodiment, the separation preventing part 66 is approximately formed in a circular shape, embodiments of the present invention are not limited thereto. The separation preventing part 66 may have any shape including a line and a polygon so long as the indicator 100 is held by the separation preventing part 66 and thus prevented from falling down.

The indicator 100 is mounted to the outlet 60. The indicator 100 visualizes rotating airflow by being rotated by the rotating airflow generated in the cyclone chamber 53.

The indicator 100 is provided with a body 110 formed approximately in a ring shape. The body 110 forms a closed loop having no open part. As the outlet 60 is inserted into a hole 111 in the body 110, the indicator 100 may surround the circumferential surface 61 of the outlet 60. Thereby, the indicator 100 may be mounted to the outlet 60, and the outlet 60 may support the indicator 100 such that the indicator 100 is rotatable.

As is clearly shown in FIG. 7, the inner circumferential surface 112 of the indicator 100 and the outer circumferential surface 68 of the outlet 60 may be spaced a predetermined distance from each other to prevent frictional force between the indicator 100 and the outlet 60 from interrupting smooth rotation of the indicator 100.

To this end, the inner diameter R1 of the indicator 100 may be designed to be greater than the outer diameter R2 of the outlet 60. When the indicator 100 and the outlet 60 are disposed such that the centers thereof coincide with each other, a predetermined gap G may be defined between the inner circumferential surface 112 of the indicator 100 and the outer circumferential surface 68 of the outlet 60.

Meanwhile, the indicator 100 may further include a plurality of blades 120 protruding radially outward from the body 110 to receive force from the rotating airflow. The blades 120 may be spaced a predetermined distance from each other in a circumferential direction.

As is clearly illustrated in FIG. 6, each of the blades 120 may be formed approximately in the shape of a linear rod. In addition, the central axis L of each of the blades 120 may be inclined at a predetermined angle θ with respect to a horizontal plane H.

This is intended to reduce friction by causing the indicator 100 to rise from the separation preventing part 66 when the indicator 100 rotates. In addition, disposing the blades such that the central axes thereof are approximately perpendicular to the travel direction of the rotating airflow, rotational force may be better transferred to the blades.

Herein, the inclination angle θ and inclination direction of the indicator 100 may be properly determined in consideration of the direction and intensity of the rotating airflow generated in the cyclone chamber 53, and the height of the outlet 60 to allow the indicator 100 to rotate most smoothly.

The body 110 and blades 120 of the indicator 100 may be integrally formed through injection molding of a resin material. The indicator 100 may need to be formed of a lightweight material allowing the indicator 100 to rotate and rise.

In addition, to improve visibility of the indicator 100, the indicator 100 may be provided with a proper color. In addition, the indicator 100 may be provided with a fluorescent color so as to be easily recognized even in a dark place.

Regarding installation of the indicator 100, the indicator 100 needs to be mounted to the outlet 60 before the outlet 60 is coupled to the discharge pipe 81 of the middle cover 80.

Since the indicator 100 forms a closed loop, and the separation preventing part 66 not allowing the indicator 100 to pass therethrough is provided to the lower end of the outlet 60, the indicator 100 needs to be mounted to the upper end of the outlet 60 before the outlet 60 is coupled to the discharge pipe 81 of the middle cover 80. In this way, the outlet 60 is coupled to the discharge pipe 81 of the middle cover 80 after the indicator 100 is mounted to the outlet 60.

Meanwhile, the middle cover 80 includes a discharge pipe 81 to guide air discharged through the outlet 60, a micro filter 84 to filter out fine dust in the air discharged through the outlet 60, and a filter mounting part 83 to which the micro filter 84 is mountable.

Since the middle cover 80 is detachably mounted to the case 50, the user may separate the middle cover 80 from the case 50 and then empty the dust collecting chamber 54 filled with dust.

The micro filter 84 may be a sponge, and may be detachably mounted to the filter mounting part 83. The filter mounting part 83 may be provided with an open upper surface. Accordingly, when the micro filter 84 needs to be cleaned or replaced, the user may open the upper cover 70 by rotating the upper cover 70 with respect to the middle cover 80 and then separate the micro filter 84 by lifting the micro filter 84 off the filter mounting part 83.

The upper cover 70 may be provided with a grip 71 allowing easy opening of the upper cover 70, and an outlet 72 through which the air re-purified through the micro filter 84 is discharged from the cyclone dust collector 40.

Hereinafter, operation of the vacuum cleaner constructed as above will be described.

When the fan motor (not shown) of the main body 10 is driven, the suction force of the fan motor (not shown) causes the suction part 21 to suction air from a surface to be cleaned. The suctioned air sequentially passes through the extension pipe 20, the handle pipe 30, and the flexible hose 23, and then flow into the cyclone dust collector 40 mounted to the main body 10.

The air introduced into the cyclone dust collector 40 is guided into the cyclone chamber 53 through the inlet portion 56. The guided air is rotated around the guide 58 and lifted by the spiral part 57 in the cyclone chamber 53.

At this time, the indicator 100 rotatably mounted outside of the circumferential surface 61 of the outlet 60 is rotated by the rotating airflow generated in the cyclone chamber 53. The indicator 100 remains stationary and supported on the separation preventing part 66 provided to the lower end of the outlet 60 until the fan motor (not shown) is driven. When the fan motor (not shown) is driven and rotating airflow is generated in the cyclone chamber 53, the indicator 100 may rotate in place or may be slightly lifted off the separation preventing part 66 while rotating.

Since the case 50 defining the cyclone chamber 53 is formed of a transparent material, it may allow a user to see the indicator 100 rotate. Thereby, the user may recognize generation of rotating airflow in the cyclone chamber 53.

Meanwhile, the dust heavier than air is dispersed radially outward by the centrifugal force and directed toward the dust collecting chamber 54 through the opening 55. Then, the dust falls due to gravity, and is then collected in the dust collecting chamber 54.

The air from which dust has been primarily removed by the centrifugal force passes through the grille 63 of the outlet 60. At this time, dust particles having a size greater than or equal to a certain size are secondarily filtered out. After passing through the grille 63 of the outlet 60 is guided upward through the outlet 60 and the discharge pipe 81. Fine dust is filtered out by the micro filter 84 provided to the middle cover 80.

The purified air finally leaves the cyclone dust collector 40 through the outlet 72 of the upper cover 70, and then leaves the main body 10 via the fan motor chamber (not shown).

Figure 8:
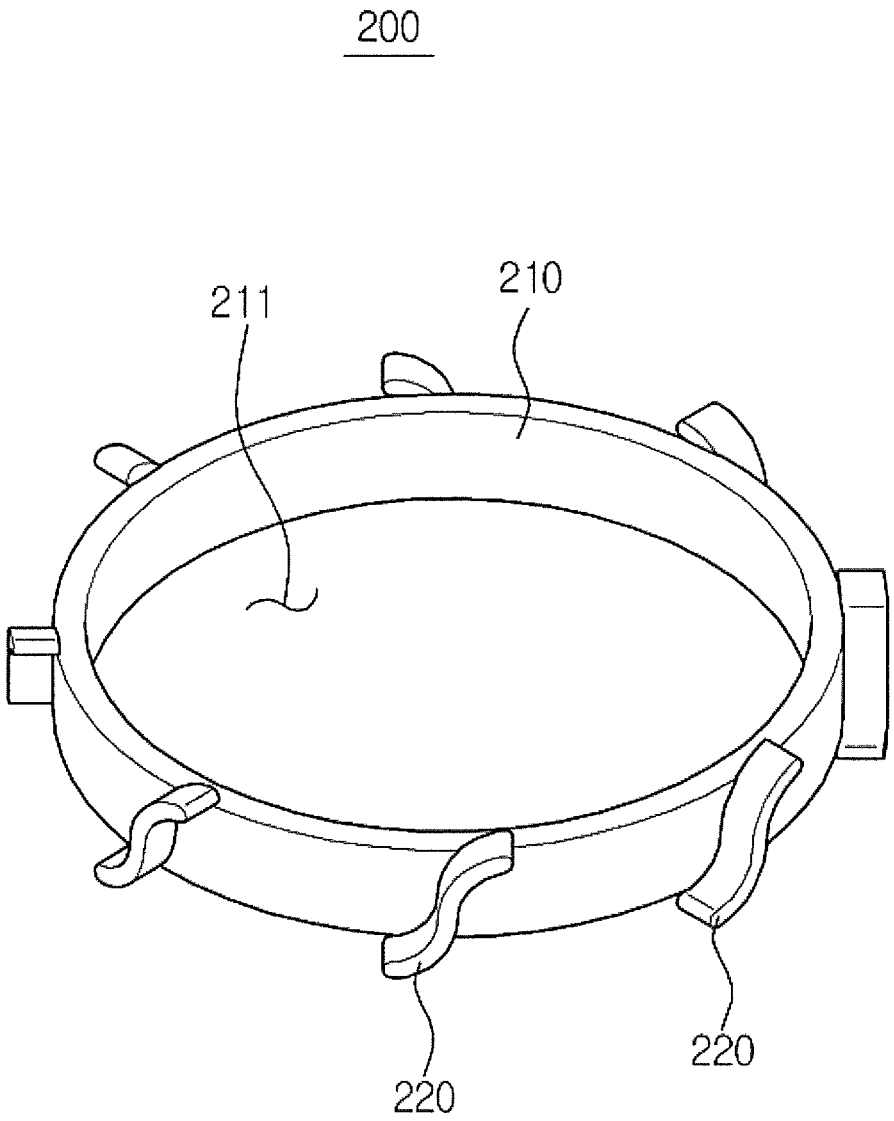
FIG. 8 is a view illustrating a variation of the indicator of FIG. 1.
Figure 9:
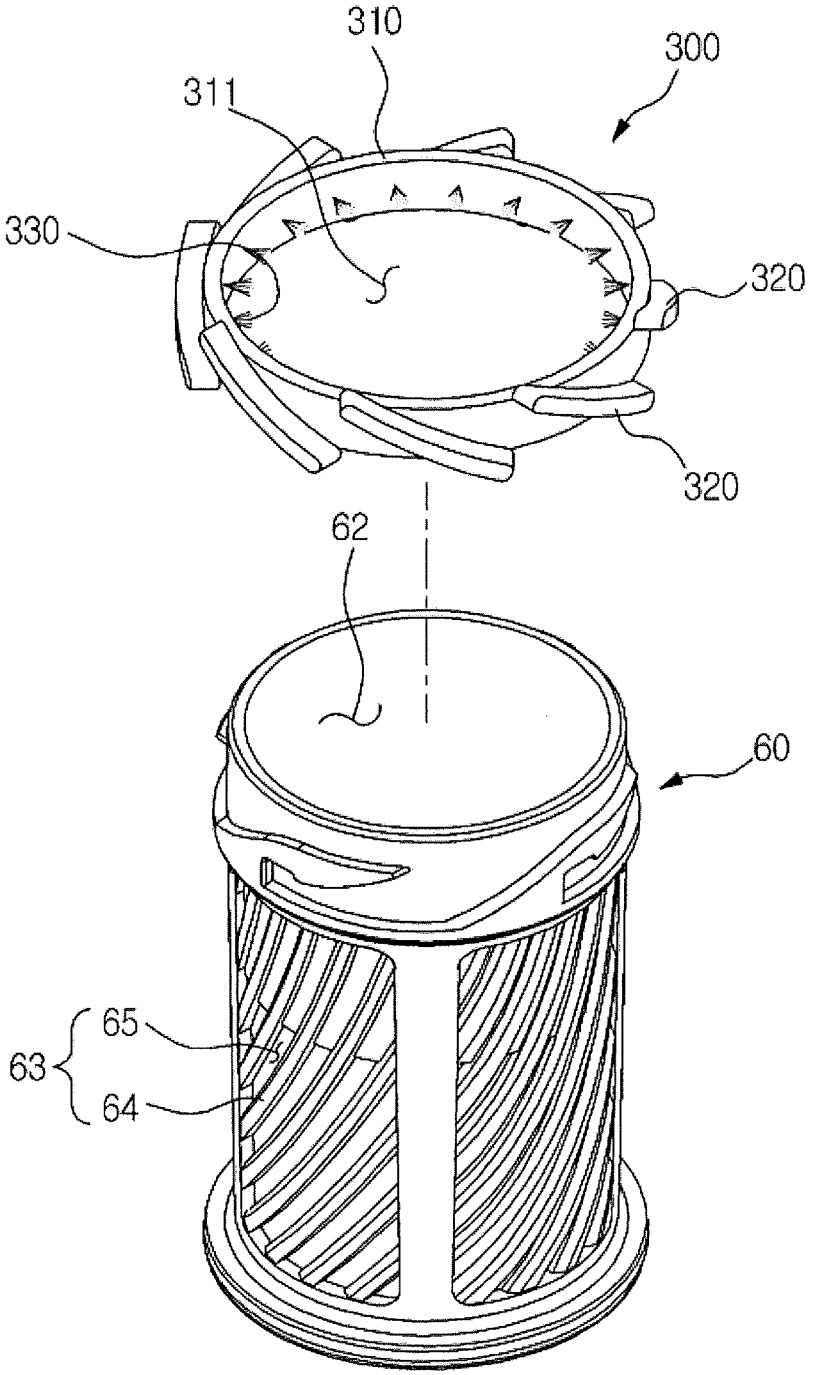
FIG. 9 is a view illustrating another variation of the indicator of FIG. 1 and the outlet.

FIG. 8 is a view illustrating a variation of the indicator of FIG. 1, FIG. 9 is a view illustrating another variation of the indicator of FIG. 1 and the outlet.

Referring to FIGS. 8 and 9, the indicator of the illustrated embodiment may take various forms.

As shown in FIG. 8, an indicator 200, a first variation, includes a ring-shaped body 210 having a hollow 211 and a plurality of blades 220 protruding radially outward from the body 210. The body 210 forms a closed loop.

Herein, each of the blades 220 of the first variation may have a shape of a non-linear rod. That is, as shown in FIG. 8, each of the blades 220 may be formed in an approximately S-shaped rod. Due to this shape, force from the rotating airflow in the cyclone chamber may be better applied to the blades 220.

The first variation is simply illustrative, and the blades 220 may have various shapes.

As shown in FIG. 9, an indicator 300, a second variation, includes a ring-shaped body 310 having a hollow 311, a plurality of blades 320 protruding radially outward from the body 310, and a brush 330 arranged radially inside of the body 310 to clean the outlet 60 when the indicator 300 rotates.

The brush 330 may sweep out dust clogging the through hole 65 during rotation of the indicator 300 by contacting the grille 63 of the outlet 60. Accordingly, the brush 330 may include soft and thin hairs.

Since the indicator 300 is capable of ascending and descending while rotating about the outlet 60, proper design of the indicator 300 and the force of rising airflow may allow the indicator 300 to clean the entire area from the upper end to the lower end of the grille 63.

Figure 10:
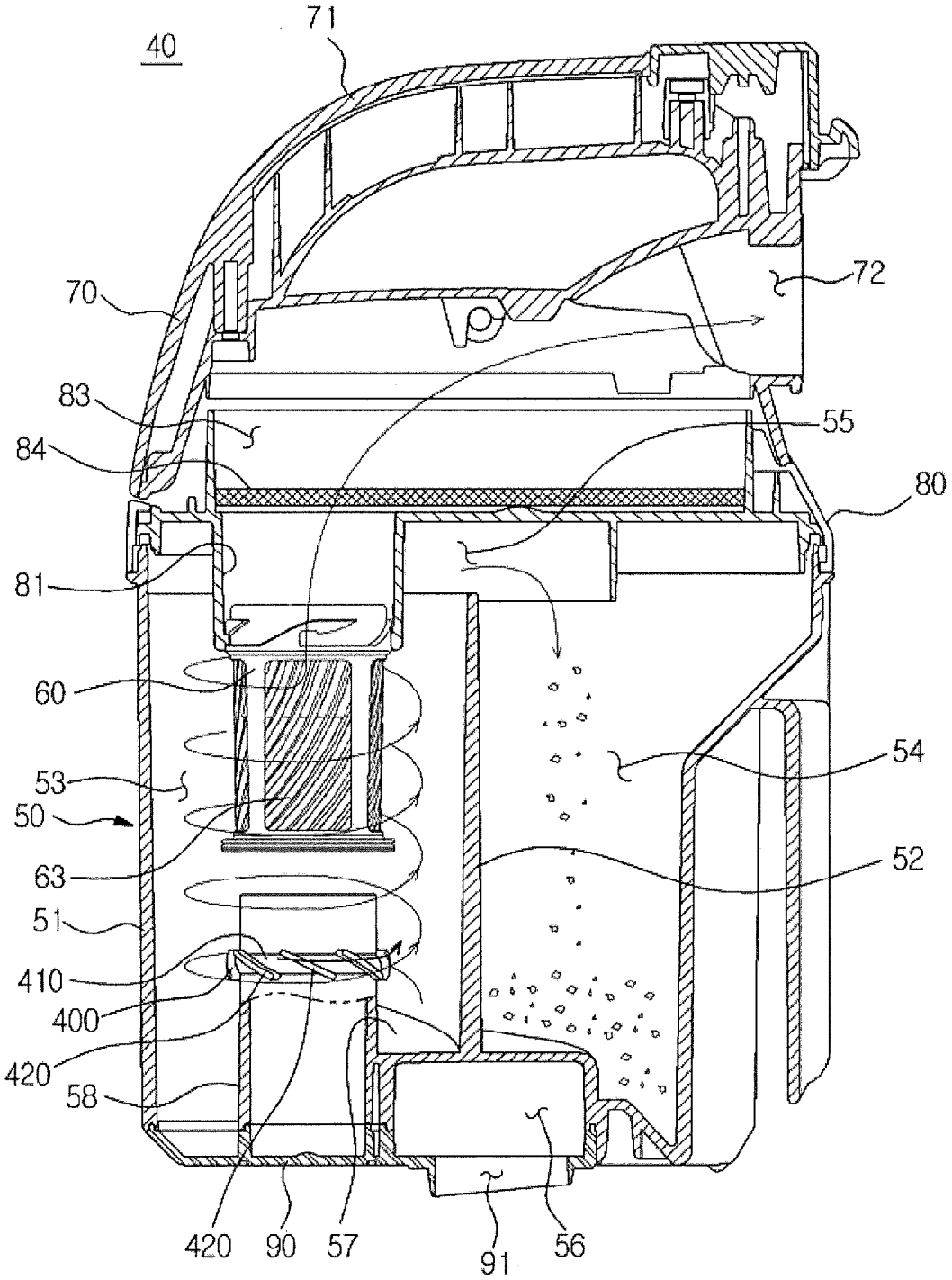
FIG. 10 is a view exemplarily illustrating mounting of the indicator of FIG. 1 to the guide.

FIG. 10 is a view exemplarily illustrating mounting the indicator of FIG. 1 to the guide. In the cross-sectional view of FIG. 10, cross sections of a part of the guide 58 and the indicator 400 are not shown and only the appearance thereof seen from the front is shown, for simplicity of illustration.

Some constituents of the variation shown in FIG. 10 identical to those of the previous embodiment will be assigned with the same reference numerals as in the previous embodiment, and a description thereof will be omitted.

The cyclone dust collector 40 includes a cyclone chamber 53 to create rotating airflow to centrifugally separate the dust, a dust collecting chamber 54 to collect the dust separated by the rotating airflow, a guide 58 formed approximately in a cylindrical shape at the center of the cyclone chamber 53 to guide the rotating airflow, a spiral part 57 spirally inclined around the guide 58, and an indicator 400 mounted to the guide 58 so as to visualize the rotating airflow by being rotated by the rotating airflow in the cyclone chamber 53.

The indicator 400 may include a body 410 forming a ring-shaped closed loop, and a plurality of blades 420 protruding radially outward from the body 410 to receive force from the rotating airflow.

The indicator 400 may be rotatably mounted to the circumferential surface of the guide 58 to surround the guide 58. Although not separately shown, the inner diameter of the body 410 of the indicator 400 may be designed to be greater than the outer diameter of the guide 58 to reduce friction between the indicator 400 and the guide 58 such that the indicator 400 smoothly rotates.

In this variation of the first embodiment, the indicator 400 is mounted to the guide 58, rather than to the outlet 60. The outlet 60 and the guide 58 are both cylindrically formed. Thereby, the indicator 400 may be rotatably supported by the outlet 60 and the guide 58.

From the above point of view, the outlet 60 and the guide 58 may be generally defined as cylindrical parts. In addition, the indicator 400 is mountable to the guide 58 rather than to the outlet 60 as in this variation. Further, it may be mounted to a cylindrical part provided in the cyclone chamber 53. This is because the cylindrical part may be inserted into the indicator 400 to rotatably support the indicator 400, for example.

Figure 11:
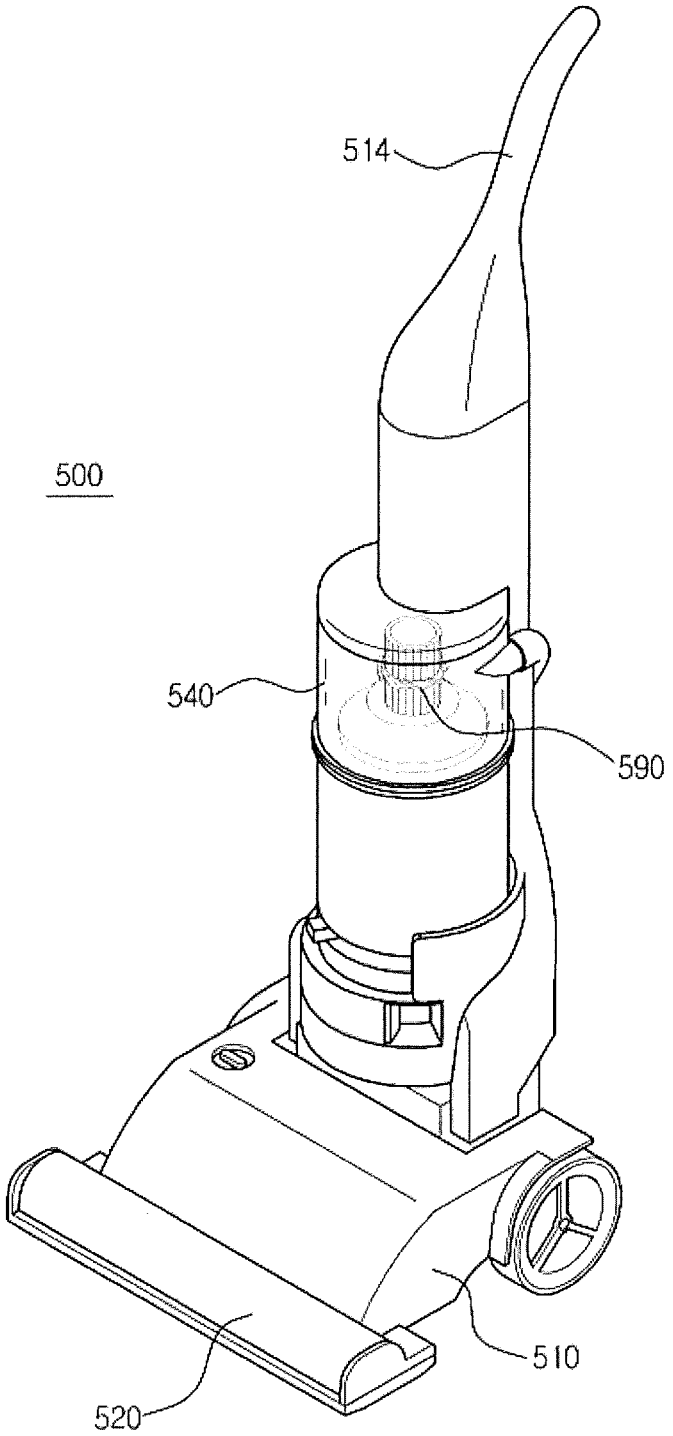
FIG. 11 is a view illustrating a vacuum cleaner according to another embodiment of the present invention.
Figure 12:
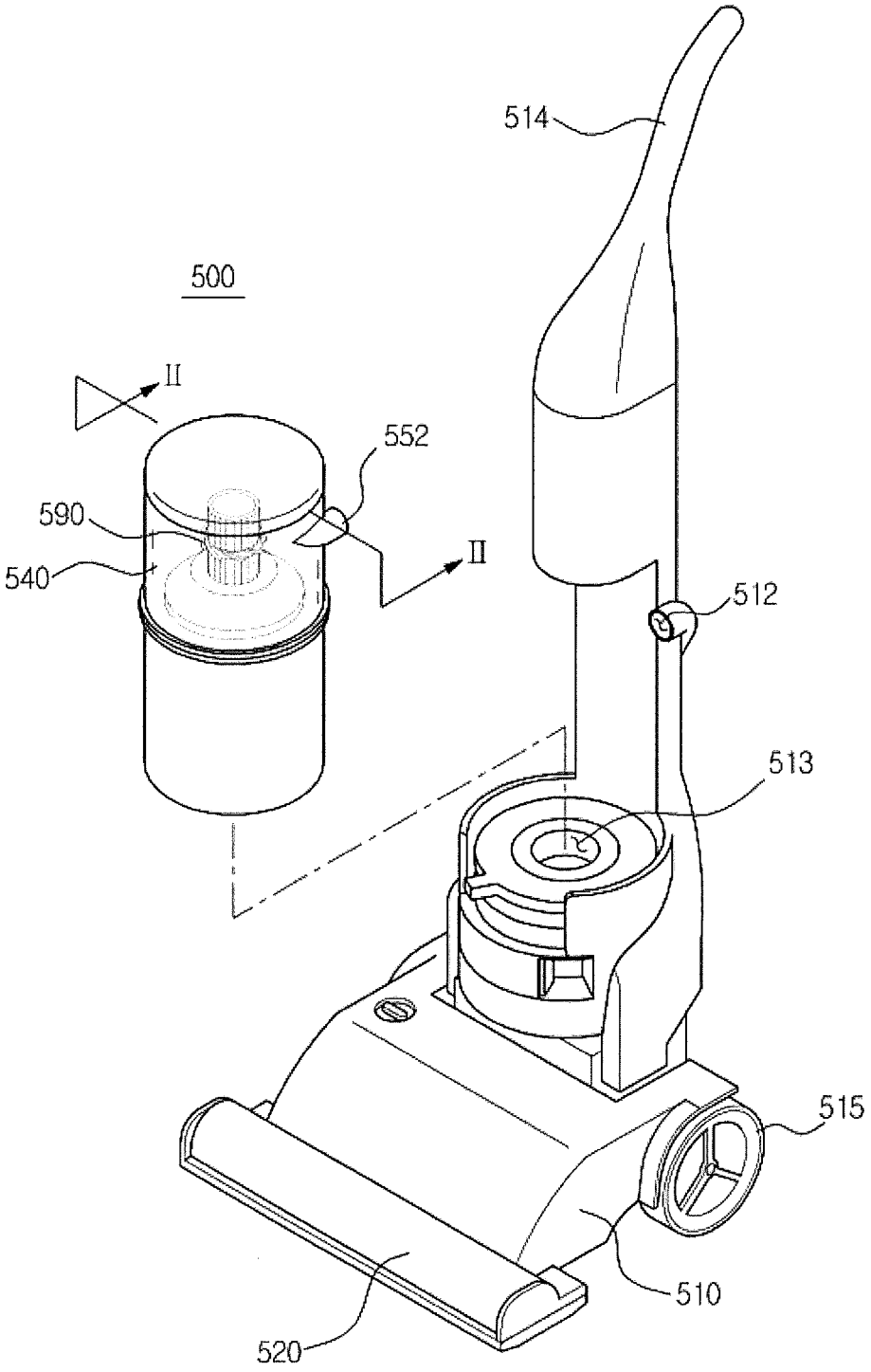
FIG. 12 is a view illustrating the vacuum cleaner of FIG. 11, in which the cyclone dust collector is separated from the main body.

FIG. 11 is a view illustrating a vacuum cleaner according to another embodiment of the present invention, and FIG. 12 is a view illustrating the vacuum cleaner of FIG. 11, in which the cyclone dust collector is separated from the main body.

Referring to FIGS. 11 and 12, the vacuum cleaner of this embodiment, which is an upright type vacuum cleaner different from the previous embodiment, includes a main body 510, a suction part 520 to contact a surface to be cleaned to suction air, and a cyclone dust collector 540 mounted to the main body 510. The suction part 520 may be directly connected to the main body 510, not via a separate hose, for example.

A fan motor (not shown) to generate suction force is provided in the main body 510. A grip 514 may be vertically arranged at the upper side of the main body 510, and a wheel 515 to move the main body 510 may be arranged at the lower end of the main body 510. The suction part 520 may be provided with a suction brush (not shown) to facilitate cleaning of objects such as a carpet.

The main body 510 may be provided with a mounting part 511 to which the cyclone dust collector 540 is mountable, and the cyclone dust collector 540 may be detachably mounted to the mounting part 511.

Once the cyclone dust collector 540 is mounted to the mounting part 511, the inlet part 552 of the cyclone dust collector 540 may communicate with the suction port 512 of the main body 510, and the exhaust pipe 581 of the cyclone dust collector 540 may communicate with the discharge port 513 of the main body 510.

Accordingly, the air suctioned through the suction part 520 may be introduced into the cyclone dust collector 540 via the suction port 512 of the main body 510 and the inlet part 552 of the cyclone dust collector 540. After being purified in the cyclone dust collector 540, the air may be discharged from the cyclone dust collector 540 via the exhaust pipe 581 of the cyclone dust collector 540 and the discharge port 513 of the main body 510.

Figure 13:
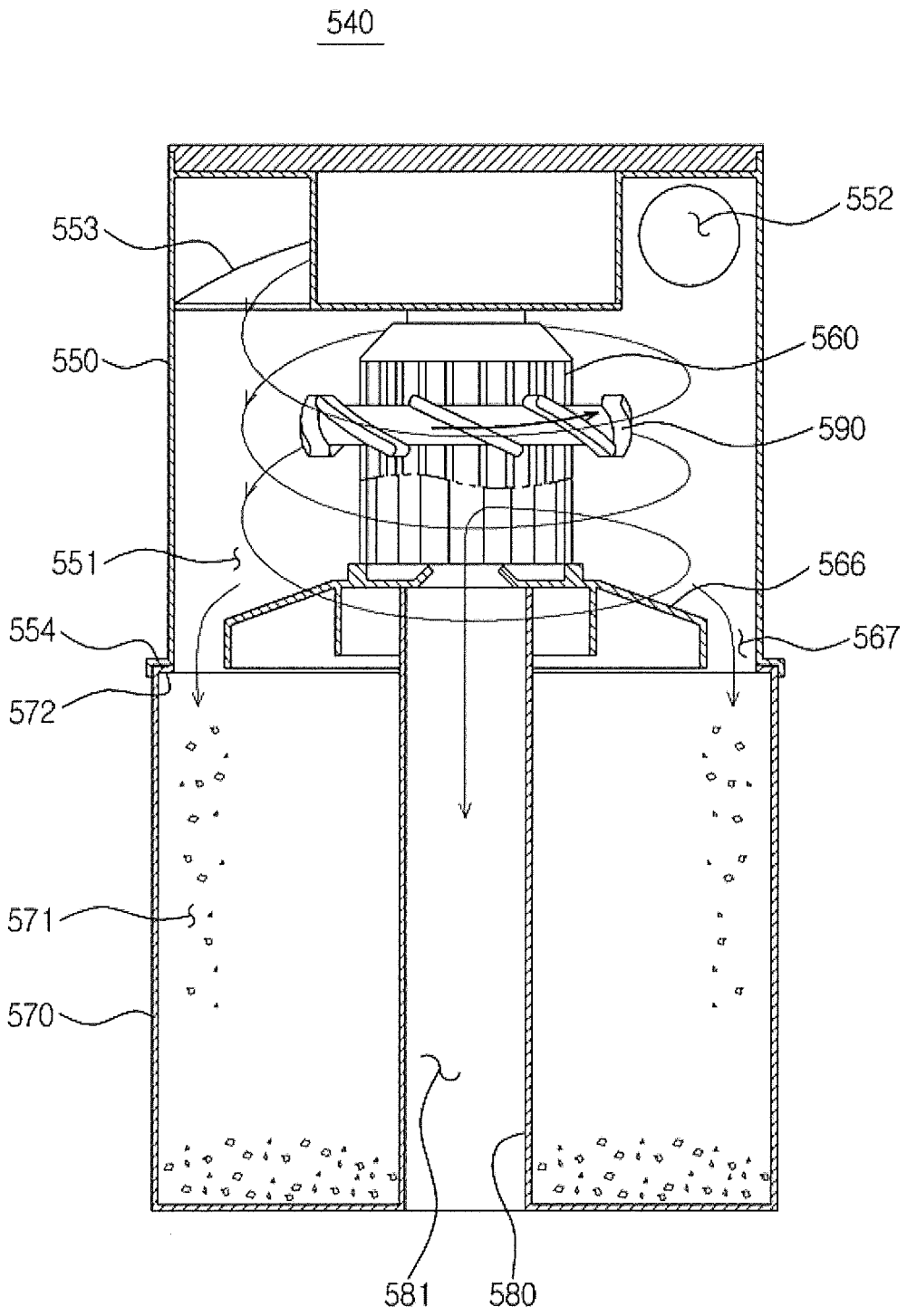
FIG. 13 is a cross-sectional view taken along line II-II of FIG. 12.
Figure 14:
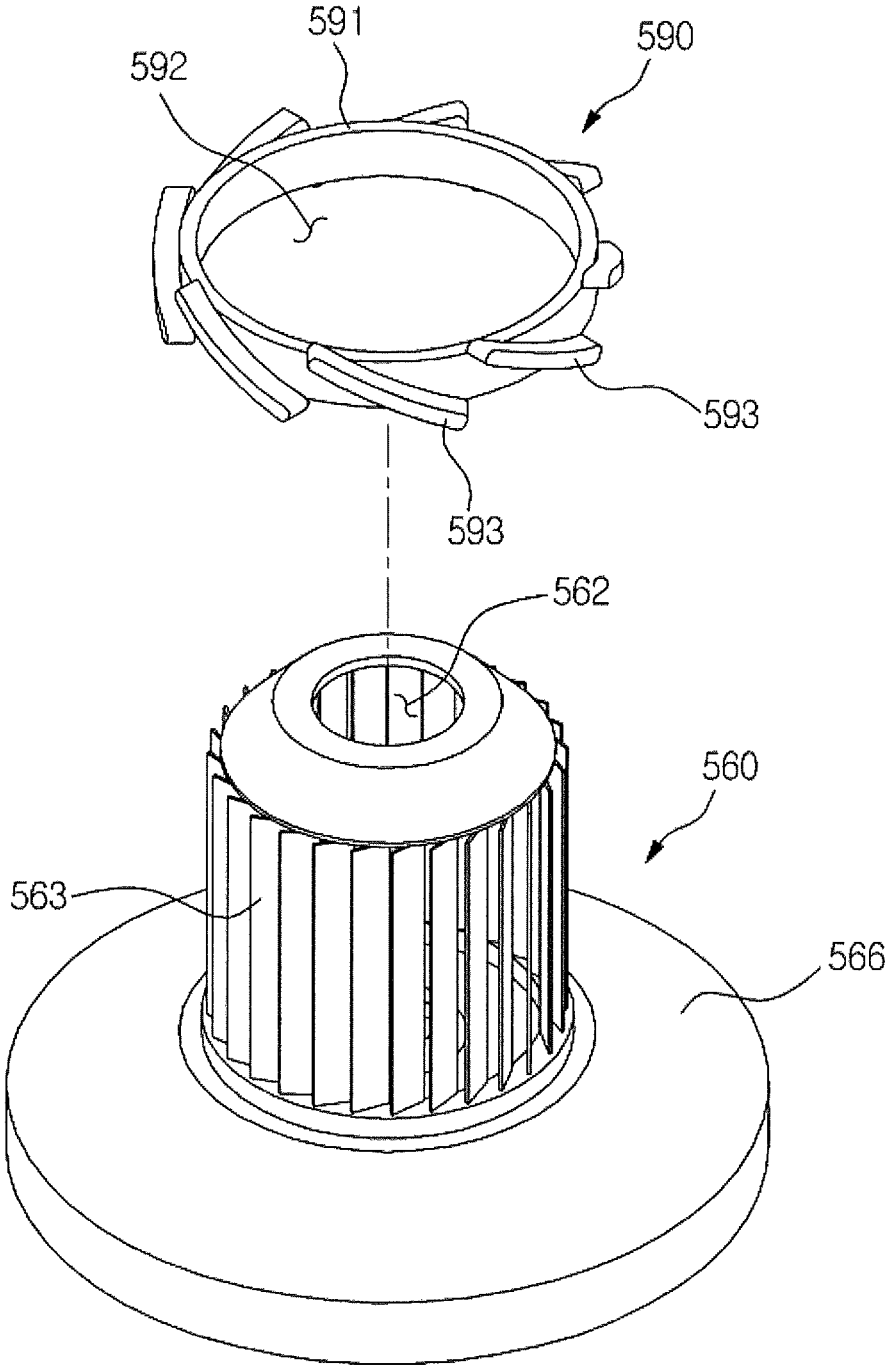
FIG. 14 is a perspective view illustrating the outlet and indicator of FIG. 11.

FIG. 13 is a cross-sectional view taken along line II-II of FIG. 12. FIG. 14 is a perspective view illustrating the outlet and indicator of FIG. 11. In the cross-sectional view of FIG. 13, cross sections of a part of the outlet 560 and the indicator 590 are not shown and only the appearance thereof seen from the front is shown, for simplicity of illustration.

As is clearly illustrated in FIG. 13, the cyclone dust collector 540 may include an upper case 550 in which a cyclone chamber 551 is defined, and a lower case 570 in which a dust collecting chamber 571 is formed.

The upper case 550 may have an approximately cylindrical shape and an open lower surface. The lower case 570 may have an approximately cylindrical shape and an open upper surface. The upper case 550 or both the upper case 550 and the lower case 570 may be formed of a transparent material such that the interior thereof is visible.

The upper case 550 and the lower case 570 are respectively provided with a first coupling part 554 and a second coupling part 572, which are coupled to each other. Through coupling between the first coupling part 554 and the second coupling part 572, the upper case 550 and the lower case 570 may be coupled to each other. By coupling the upper case 550 with the lower case 570, the cyclone chamber 551 may communicate with the dust collecting chamber 571.

The cyclone dust collector 540 includes an inlet part 552 through which air is introduced into the cyclone chamber 551, a spiral part 553 spirally inclined to rotate the air introduced through the inlet part 552, and an outlet 560 through which the air having undergone removal of dust through rotating airflow is discharged from the cyclone chamber 551.

The inlet part 552 may be provided approximately to the upper portion of one side of the cyclone chamber 551, and the air introduced through the inlet part 552 may fall, rotating round the outlet 560.

The outlet 560 is formed approximately in the shape of a cylinder having an inner space 562 and provided at the center of the cyclone chamber 551. A grille 563 may be provided to the circumferential surface of the outlet 560 to prevent dust particles having a size greater than or equal to a certain size from passing therethrough. The shape of the grille 563 is not limited.

The outlet 560 communicates with an exhaust pipe 580 provided in the lower case 570 to penetrate the dust collecting chamber 571. Accordingly, the purified air introduced into the inner space 562 of the outlet 560 may be discharged from the cyclone dust collector 540 through the discharge passage 581 of the exhaust pipe 580.

The dust dispersed radially outward by the rotating airflow of the cyclone chamber 551 falls due to gravity and is collected in the dust collecting chamber 571. By separating the lower case 570 from the upper case 550, the user may remove the dust collected in the dust collecting chamber 571.

A skirt 566 may be provided to the lower end of the outlet 560 to prevent backflow of dust collected in the dust collecting chamber 571 into the cyclone chamber 551. The skirt 566 protrudes radially outward from the lower end of the outlet 560, and an opening 567 is defined between the skirt 566 and the cases 550 and 570 to allow the dust in the cyclone chamber 551 to move to the dust collecting chamber 571.

The indicator 590 to visualize the rotating airflow by being rotated by the rotating airflow in the cyclone chamber 551 is mounted to the outlet 560.

The indicator 590 may include a body 591 having a ring shape and forming a closed loop, a hole 592 formed in the body 591, and a plurality of blades 593 protruding radially outward from the body 591 to receive force from rotating airflow.

Details of the indicator 590 are the same as those in the previous embodiment and variations thereof, and a description thereof will be omitted.

The indicator 590 may be rotatably mounted to the outer circumferential surface of the outlet 560 to surround the outlet 560. The mounting structures of the indicator 590 and the outlet 560 are the same as those in the previous embodiment and variations thereof, and other details will not be described.

The skirt 566 provided to the lower end of the outlet 560 may function as a separation preventing part that prevents the indicator 590 from being separated.

Hereinafter, operation of the vacuum cleaner of this embodiment will be described. When the fan motor (not shown) of the main body 510 is driven, the suction force of the fan motor (not shown) causes the suction part 21 to suction air on a surface to be cleaned. The suctioned air is introduced into the cyclone dust collector 540 mounted to the main body 510.

The air introduced into the cyclone dust collector 540 is guided into the cyclone chamber 551 through the inlet portion 552. The guided air falls, rotating around the spiral part 553 in the cyclone chamber 551.

At this time, the indicator 590 rotatably mounted outside the circumferential surface of the outlet 560 is rotated by the rotating airflow. The indicator 590 remains stationary and supported on the skirt 566 provided to the lower end of the outlet 560 until the fan motor (not shown) is driven. When the fan motor (not shown) is driven and rotating airflow is generated in the cyclone chamber 551, the indicator 590 may rotate in place or may be slightly lifted off the skirt 566 while rotating.

The dust is dispersed radially outward by the rotating airflow. The dispersed dust falls due to gravity and is then collected in the dust collecting chamber 571. The air from which dust has primarily been removed by the centrifugal force may undergo secondary removal of dust while passing through the grille 563 of the outlet 560, and then be discharged from the cyclone dust collector 40 through the exhaust pipe 580.

Figure 15:
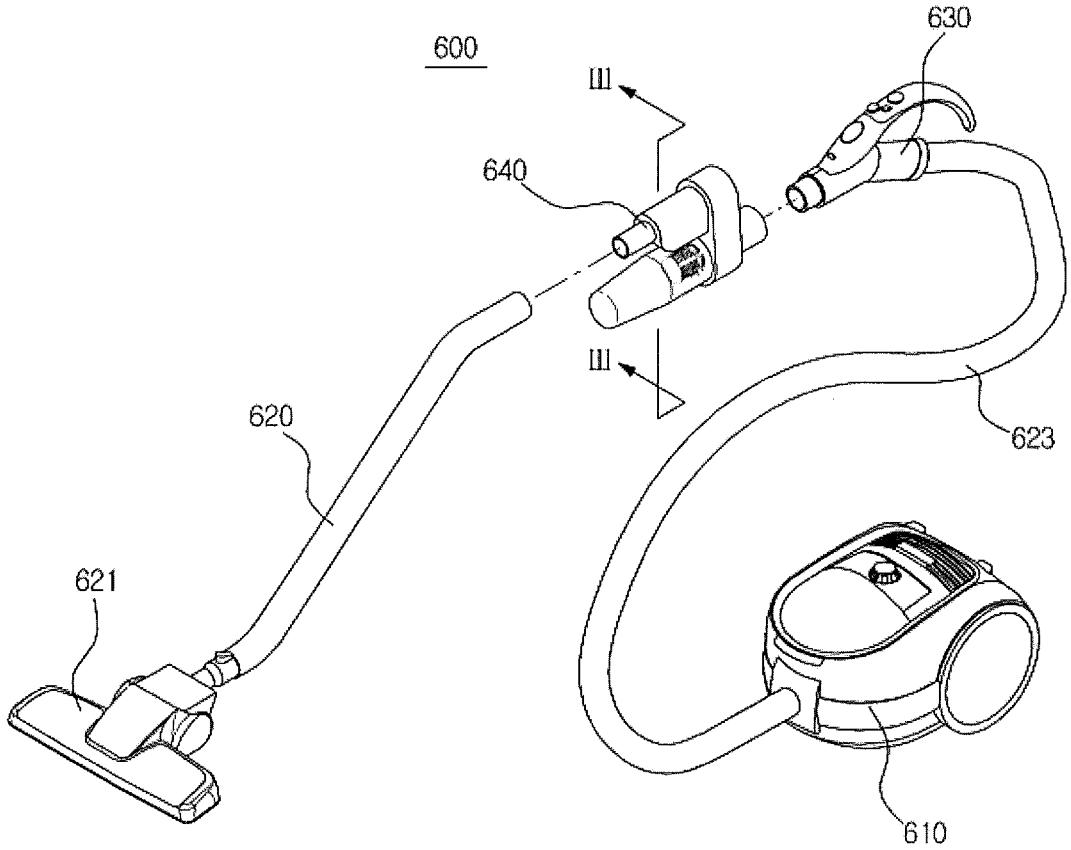
FIG. 15 is a view illustrating a vacuum cleaner according to another embodiment of the present invention.
Figure 16:
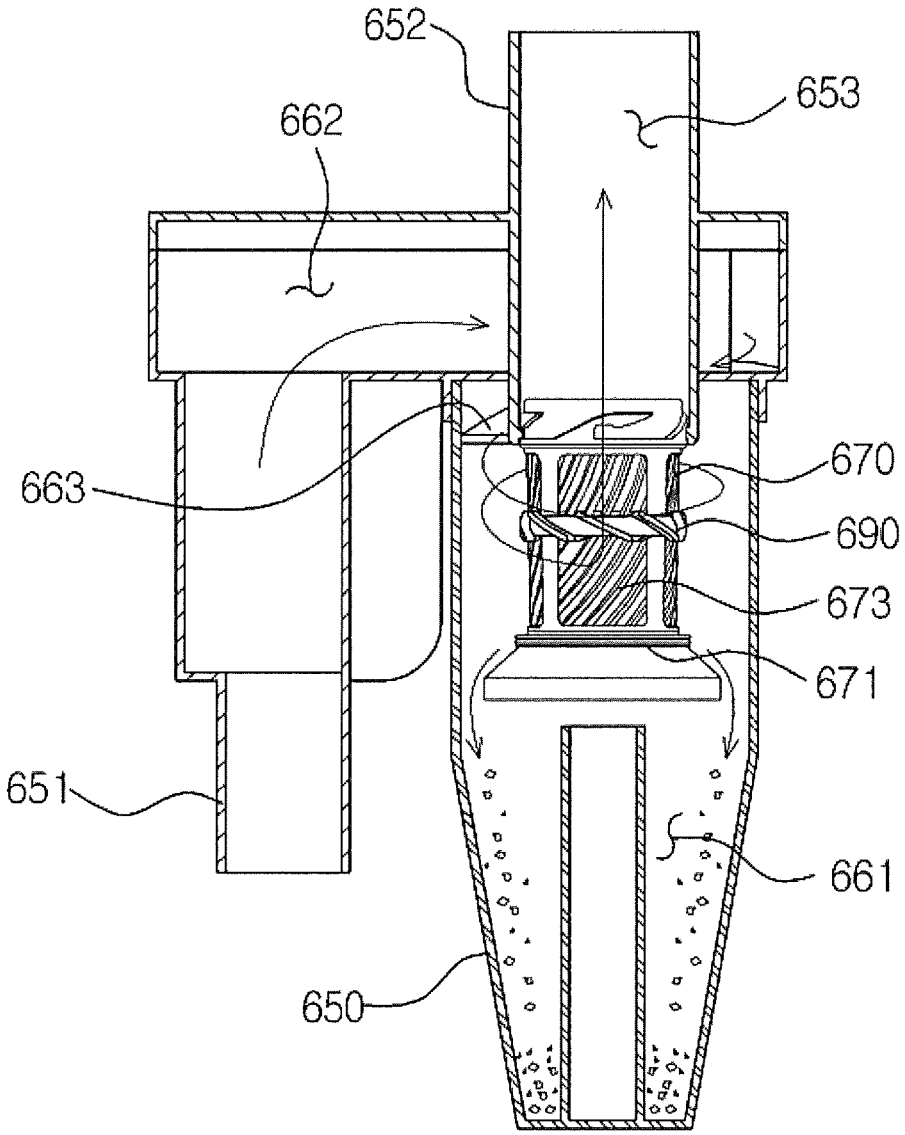
FIG. 16 is a cross-sectional view taken along line III-III of FIG. 15.

FIG. 15 is a view illustrating a vacuum cleaner according to another embodiment of the present invention, and FIG. 16 is a cross-sectional view taken along line III-III of FIG. 15. In the cross-sectional view of FIG. 16, cross sections of the outlet port 670 and the indicator 690 are not shown and only the appearance thereof seen from the front is shown, for simplicity of illustration.

Hereinafter, a vacuum cleaner according to another embodiment of the present invention will be described with reference to FIGS. 15 and 16. Constituents already disclosed in the previous embodiments and variations thereof may not be described.

A vacuum cleaner 600 of this embodiment includes a main body 610 to generate suction force, a suction part 621 to contact a surface to be cleaned to suction air, an extension pipe 620 coupled to the suction part 621, a handle conduit 630 manipulated by a user, a flexible hose 623 to connect the handle pipe 630 to the main body 610, and a cyclone dust collector 640 coupled between the extension pipe 620 and the handle pipe 630.

The cyclone dust collector 640 may be arranged in compact form between the extension pipe 620 and the handle pipe 630 to preliminarily remove dust from the air and collect the same before the dust is introduced into the main body 610.

The cyclone dust collector 640 may include a cyclone case 650 provided therein with a cyclone chamber 660 and a dust collecting chamber 661, an extension pipe coupling pipe 651 coupled to the extension pipe 620 to allow air to be introduced thereinto from the extension pipe 620, and a handle pipe coupling pipe 652 coupled to the handle pipe 630 to allow the air having undergone removal of dust to be discharged toward the handle pipe 630.

Among the cyclone case 650, the extension pipe coupling pipe 651, and the handle pipe coupling pipe 652, at least the cyclone case 650 may be formed of a transparent material to allow the interior thereof to be visible.

In addition, the cyclone dust collector 640 may include an inlet part 662 to connect the interior of the extension pipe coupling pipe 651 to the cyclone chamber 660, a spiral part 663 spirally inclined such that rotating airflow is created in the cyclone chamber 660, an outlet 670 to connect the cyclone chamber 660 to the discharge passage 653 of the handle pipe coupling pipe 652, a skirt 671 provided to the lower end of the outlet 670 to prevent dust collected in the dust collecting chamber 661 from being moved backward into the cyclone chamber 660 by the rotating airflow, and an indicator 690 rotatably mounted to the outlet 670 to visualize the rotating airflow by being rotated by the rotating airflow. A grille 673 may be provided to the circumferential surface of the outlet 670 to prevent dust particles having a size greater than or equal to a certain size from passing therethrough.

Other constituents and operations of the indicator 690 and the outlet 670 are disclosed in the previous embodiments and thus a description thereof will be omitted.

The technical spirit of the present invention has been described above with specific embodiments. However, the scope of the present invention is not limited to the described embodiments.

Particularly, in the disclosed embodiments, a canister type vacuum cleaner, an upright type vacuum cleaner, and a canister type vacuum cleaner with a cyclone dust collector coupled to a handle pipe have been described. However, the spirit of the present invention is not limited to the described types of vacuum cleaners and is applicable to any type of vacuum cleaners with a cyclone dust collector.

As is apparent from the above description, a cyclone dust collector according to an embodiment of the present invention may visualize rotating airflow through an indicator.

In addition, intensity of suction force may be visualized by rate of rotation of the indicator.

Further, a user may easily determine malfunction of the fan motor, clogging of a flow passage, and a time to clean the filter based on rotation of the indicator and take proper actions.

Although a few embodiments of the present invention have been shown and described, it would be appreciated by those skilled in the art that changes may be made to the embodiments without departing from the principles and spirit of the invention, the scope of which is defined in the claims and their equivalents.

What is claimed is:

1. A cyclone dust collector comprising:

an inlet portion to suction air therethrough;

a cyclone chamber to centrifugally separate dust by rotating the air suctioned through the inlet portion;

a dust collecting chamber communicating with the cyclone chamber to collect the dust separated through the cyclone chamber;

a cylindrical outlet provided in the cyclone chamber to allow the air having undergone removal of the dust to be discharged from the cyclone chamber therethrough; and an indicator mounted to the outlet so as to be rotated by rotating airflow in the cyclone chamber, the indicator comprising a ring-shaped body and a plurality of blades protruding radially outward from the body.

2. The cyclone dust collector according to claim 1, wherein the indicator is rotatably mounted to a circumferential surface of the outlet to surround the outlet.

3. The cyclone dust collector according to claim 1, wherein the outlet comprises a grille adapted to filter out dust particles having a size greater than or equal to a certain size.

4. The cyclone dust collector according to claim 1, wherein an inner diameter of the body of the indicator is greater than an outer diameter of the outlet.

5. The cyclone dust collector according to claim 1, wherein the outlet comprises a separation preventing part protruding radially outward from a lower end of the outlet to prevent the indicator from being separated from the outlet.

6. The cyclone dust collector according to claim 1, wherein the blades are spaced a predetermined distance from each other in a circumferential direction.

7. The cyclone dust collector according to claim 1, wherein each of the blades is formed in a shape of a rod.

8. The cyclone dust collector according to claim 7, wherein the rod is a linear rod or a non-linear rod.

9. The cyclone dust collector according to claim 1, wherein the blades are inclined with respect to a horizontal plane.

10. The cyclone dust collector according to claim 1, wherein the indicator further comprises a brush provided to an inside of the body in a radial direction to clean the outlet when the indicator rotates.

11. The cyclone dust collector according to claim 1, further comprising a case forming an external appearance of the cyclone dust collector and provided therein with the cyclone chamber, wherein the case is formed of a transparent material to allow the indicator to be seen through the case from outside of the case.

12. The cyclone dust collector according to claim 1, wherein the indicator has a color or is fluorescent.

13. A cyclone dust collector comprising:

a cyclone chamber to centrifugally separate dust by creating rotating airflow;

a dust collecting chamber communicating with the cyclone chamber to collect the dust separated through the cyclone chamber;

a cylindrical guide provided in the cyclone chamber to guide the rotating airflow in the cyclone chamber; and an indicator mounted to the guide so as to be rotated by the rotating airflow in the cyclone chamber, the indicator comprising a ring-shaped body and a plurality of blades protruding radially outward from the body.

14. The cyclone dust collector according to claim 13, wherein the indicator is rotatably mounted to a circumferential surface of the guide to surround the guide.

15. The cyclone dust collector according to claim 13, wherein an inner diameter of the body of the indicator is greater than an outer diameter of the guide.

16. A cyclone dust collector comprising:

a cyclone chamber to centrifugally separate dust by creating rotating airflow;

a dust collecting chamber communicating with the cyclone chamber to collect the dust separated through the cyclone chamber; and a ring-shaped indicator mounted around an outlet of the cyclone chamber so as to be rotated by rotating airflow in the cyclone chamber.

17. The cyclone dust collector according to claim 16, wherein the indicator comprises a plurality of blades protruding radially outward from the indicator.

18. The cyclone dust collector according to claim 16, further comprising a cylindrical part inserted in a hollow of the indicator to rotatably support the indicator.

19. The cyclone dust collector according to claim 18, wherein an inner diameter of the indicator is greater than an outer diameter of the cylindrical part.

20. A vacuum cleaner comprising:

a main body;

a suction part to suction air from a surface to be cleaned with suction force produced in the main body; and a cyclone dust collector connected to the suction part to suction air, centrifugally separate and collect dust, and discharge purified air, wherein the cyclone dust collector comprises:

a cyclone chamber to centrifugally separate dust by creating rotating airflow;

a dust collecting chamber communicating with the cyclone chamber to collect the dust separated through the cyclone chamber; and a ring-shaped indicator mounted around an outlet of the cyclone chamber so as to be rotated by the rotating airflow in the cyclone chamber.

21. A vacuum cleaner comprising:

a cyclone dust collector generating rotating airflow and comprising a cylindrical guide provided in the cyclone chamber to guide the rotating airflow in the cyclone chamber and an indicator mounted around the guide so as to be rotated by the rotating airflow and indicating a force of the rotating airflow in the cyclone dust collector.

22. The vacuum cleaner according to claim 21, wherein the indicator is a ring-shaped indicator rotated by the rotating airflow.

23. The vacuum cleaner according to claim 22, wherein a reduction in the rotating airflow is indicated by the indicator.

24. The vacuum cleaner according to claim 22, further comprising:

a main body; and a suction part to suction air from a surface to be cleaned with suction force produced in the main body, wherein the cyclone dust collector is connected to the suction part to suction air, centrifugally separate and collect dust, and discharge purified air, and wherein the indicator indicates one of a reduction of airflow through a flow passage of the suctioned air and a reduction in the suction force produced in the main body.

25. The vacuum cleaner according to claim 21, wherein the vacuum cleaner comprises one of a canister type vacuum cleaner, an upright type vacuum cleaner, and a canister type vacuum cleaner with a cyclone dust collector coupled to a handle pipe.

* * * * *